US007100635B1

(12) United States Patent
Wagner

(10) Patent No.: US 7,100,635 B1
(45) Date of Patent: Sep. 5, 2006

(54) SYSTEM AND METHOD FOR STORAGE AND MIXING OF SOLUTION THAT IS NOT COMPATIBLE FOR LONG-TERM STORAGE IN PRE-MIXED FORMULATION

(75) Inventor: George W. Wagner, Elkton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 327 days.

(21) Appl. No.: 10/687,287

(22) Filed: Oct. 16, 2003

(51) Int. Cl.
*F17D 1/00* (2006.01)

(52) U.S. Cl. ..... 137/590; 137/266; 137/574; 137/589; 137/592

(58) Field of Classification Search ..... 137/266, 137/557, 558, 574, 589, 592, 590
See application file for complete search history.

(56) References Cited

U.S. PATENT DOCUMENTS 719,846 A * 2/1903 Neubert et al. ..... 222/136
900,599 A * 10/1908 Setzer ..... 137/207.5
932,284 A * 8/1909 Jones ..... 137/207.5
1,404,467 A * 1/1922 Mohr ..... 8/101
2,120,865 A * 6/1938 Kleman ..... 137/238
2,692,798 A * 10/1954 Hicks ..... 239/126
2,935,057 A * 5/1960 Perlewitz ..... 123/73 A
3,119,527 A * 1/1964 Dyer ..... 222/639
3,543,787 A * 12/1970 Tepper ..... 137/266
5,868,320 A * 2/1999 Laabs et al. ..... 239/307

* cited by examiner

*Primary Examiner*—Eric Keasel
*Assistant Examiner*—Craig Price
(74) *Attorney, Agent, or Firm*—Ulysses John Biffoni

(57) ABSTRACT

A large-scale system for storage and mixing of a solution comprising a plurality of ingredients not compatible for long-term storage in a pre-mixed formulation includes a storage tank that is divided into a plurality of compartments each of which is adapted to isolate and store a proportionate amount of ingredient, fluid conduits for withdrawing and conveying the ingredients from the compartments, valves for controlling the flow of ingredients and for preventing backflow, a manifold for continuous mixing and blending of the ingredients as they are withdrawn, a sump for holding a quantity of the mixed solution, a display to enable monitoring of system parameters and a discharge port to which conduits may be coupled for withdrawing the mixed solution from the system.

6 Claims, 2 Drawing Sheets

SYSTEM AND METHOD FOR STORAGE AND MIXING OF SOLUTION THAT IS NOT COMPATIBLE FOR LONG-TERM STORAGE IN PRE-MIXED FORMULATION

GOVERNMENT INTEREST

The invention described herein may be manufactured, licensed, and used by or for the U.S. Government.

TECHNICAL FIELD

The present invention relates generally to a large-scale system for storage and mixing of a multi-ingredient solution that is not compatible for long-term storage in a pre-mixed formulation.

RELATED U.S. APPLICATION DATA

This application is related to applicant's co-pending application for "Packaging System for a Product Provided by Mixing Two or More Components," Ser. No. 10/299,093, filed on Nov. 18, 2002, commonly assigned with the present invention, and incorporated herein by reference as if fully set forth.

BACKGROUND

DECON GREEN is a solution of hydrogen peroxide, potassium carbonate, potassium molybdate, propylene carbonate and Triton® X-100 (a non-ionic surfactant) that affords the rapid, broad-spectrum decontamination of chemical warfare agents. In contrast to traditional decontaminants, which can be highly corrosive and produce undesirable and toxic byproducts, DECON GREEN is non-corrosive to common surfaces of military interest, and it leaves no toxic residues, so it is environmentally friendly. In use, carbonate and molybdate catalytically activate the peroxide. Thus, the carbonate's basicity provides peroxy anion OOH— to effect the selective perhydrolysis of nerve agents VX and GD to non-toxic products, and both carbonate and molybdate generate peroxo species which afford oxidation of blister agent HD, initially, to the nonvesicant sulfoxide. Besides chemical agents, DECON GREEN also affords the destruction of anthrax spores to undetectable levels.

Emerging decontaminating solutions such as DECON GREEN are composed of ingredients that are not compatible for prolonged storage in a pre-mixed formulation. Thus, the ingredients must be stored separately and be freshly mixed in the correct proportions shortly before being applied. While the use of an environmentally friendly decontaminant is highly desirable, to be most effective, decontamination must be performed as soon as possible after a contamination event has occurred. The additional steps required to locate all decontaminant ingredients, and to properly mix together a batch before use complicates an already time-critical process. Any such increased logistical burden must be avoided.

A currently used decontaminant, DS2 (Diethlenetriamine, Sodium Hydroxide), while highly corrosive, is stable in storage and comes pre-mixed in a can or drum and can be deployed simply by opening the container and spraying down the area to be decontaminated. The procedure for using DS2 is already ingrained in military decontamination hardware and soldier training, and it would be advantageous for a replacement decontaminant to be utilized in the same manner. Therefore, rendering the storage and ingredient mixing of a new decontaminant as simple as opening a single container, is desirable.

Co-pending application "Packaging System for a Product Provided by Mixing Two or More Components," describes a unique multi-compartment container for packaging a product, such as DECON GREEN, that includes two or more active components or ingredients. The container provides a rupture mechanism actuated by the user that causes a common wall or septum to rupture, thus permitting the contents of each of the compartments to intermingle and mix with one another in the resulting conjoined compartments.

There is also an immediate need for a large-scale storage system that can provide for long-term storage and straightforward deployment of DECON GREEN. For example, large-scale decontamination of military bases, seaports and airfields will require decontaminants on the thousands-of-gallons scale. Given the scope of this effort, large amounts of decontaminant will need to be stored for extended periods and must ready for use on a moment's notice. To be effective, correct mixing ratios and thorough mixing of ingredients will need to be observed during the process. The invention described below attains these objectives, at least in part.

SUMMARY

In general, in one aspect, a system for storage and mixing of a solution that includes a plurality of ingredients not compatible for long-term storage in a pre-mixed formulation includes a storage tank divided into a plurality of compartments, each compartment adapted to isolate and store an ingredient, a plurality of fluid conduits for withdrawing and conveying ingredients from the compartments, a manifold for mixing of the ingredients to which the fluid conduits are coupled, a sump coupled to an output aperture of the manifold for holding a quantity of the solution and comprising at least one discharge port, a plurality of control valves for regulating the flow of ingredients from the compartments to the manifold, a plurality of one way valves disposed in the fluid conduits to prevent a backflow of the ingredients into the compartments, a display device to enable monitoring of one or more system parameters, and a plurality of fill ports disposed in each compartment to load ingredients. In general, in another aspect, a method for storage and mixing of a solution including a plurality of ingredients not compatible for long-term storage in a pre-mixed formulation includes, storing the plurality of ingredients in a storage tank comprising compartments adapted to isolate and store each ingredient so that commingling will not occur during long-term storage, conveying the ingredients from the compartments to a manifold, continuously mixing the ingredients in the manifold, regulating the flow of the ingredients to enable mixing the ingredients at a desired ratio, monitoring of one or more system parameters, withdrawing the solution from the storage tank, preventing a backflow of solution into the compartments and reloading the ingredients into the storage tank.

BRIEF DESCRIPTION OF THE DRAWINGS

Various embodiments of the present invention are described in association with the following drawings, in which like items are identified by the same designation, wherein.

DETAILED DESCRIPTION

In the following detailed description of the preferred embodiments, reference is made to the accompanying drawings that form a part hereof, and in which are shown by way of illustration specific embodiments in which the invention, as claimed, may be practiced. This invention may, however, be embodied in many different forms and should not be construed as limited to the embodiments set forth; rather, these embodiments are provided so that this disclosure will be thorough and complete, and will fully convey the scope of the invention to those skilled in the art. As will be appreciated by one of skill in the art, the present invention may be embodied in systems, methods and devices.

DECON GREEN is made from a mixture of four basic components: hydrogen peroxide ($H_2O_2$), an organic solvent, a liquid surfactant, and solid powdered catalysts. As noted above, DECON GREEN is not suitable for prolonged storage in a pre-mixed formulation. It is however possible to premix some of the ingredients of DECON GREEN. For example, the organic solvent and surfactant are compatible and may be mixed together for extended storage. It may not always be desirable to premix the organic solvent and surfactant since this may complicate manufacturing and recycling of these materials. The solid catalysts may be pre-dissolved in water to facilitate handling and mixing with the other liquids. Thus, at a minimum, to facilitate large-scale mixing, DECON GREEN may be separated into three liquid components. However, none of these three components may be combined for long-term storage owing to their incompatibility.

Figure 1:
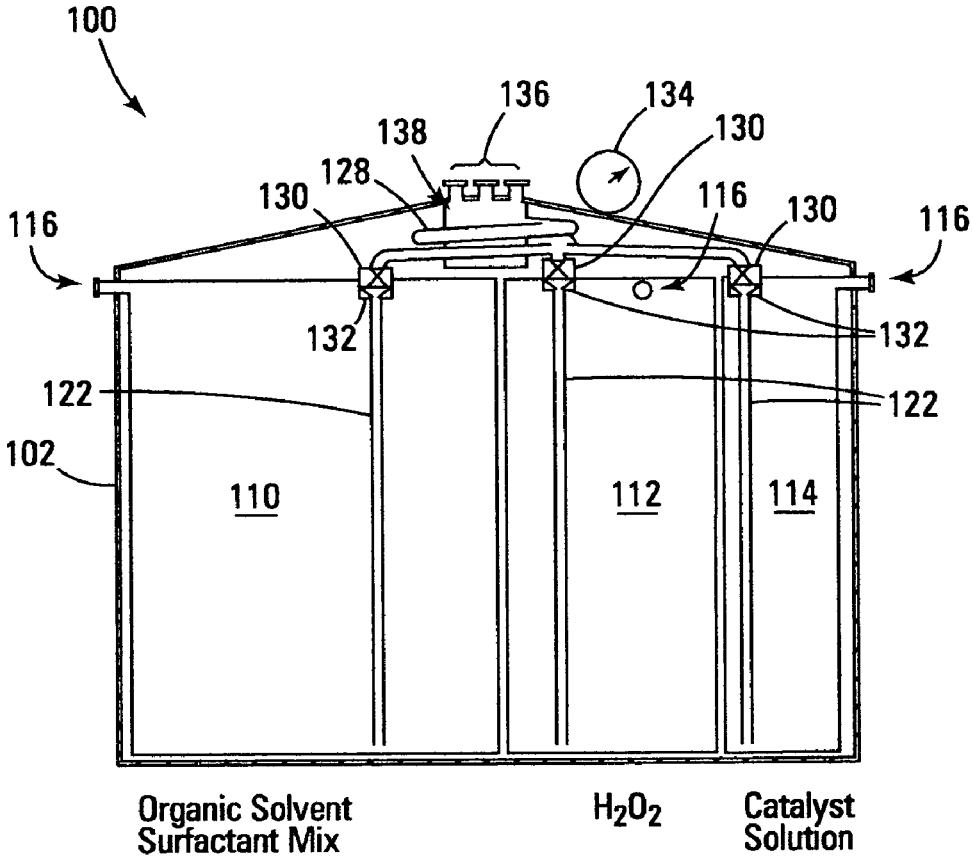
FIG. 1 represents a schematic view of an embodiment of a system for storage and mixing of a multi-ingredient solution according to the present invention.
Figure 2:
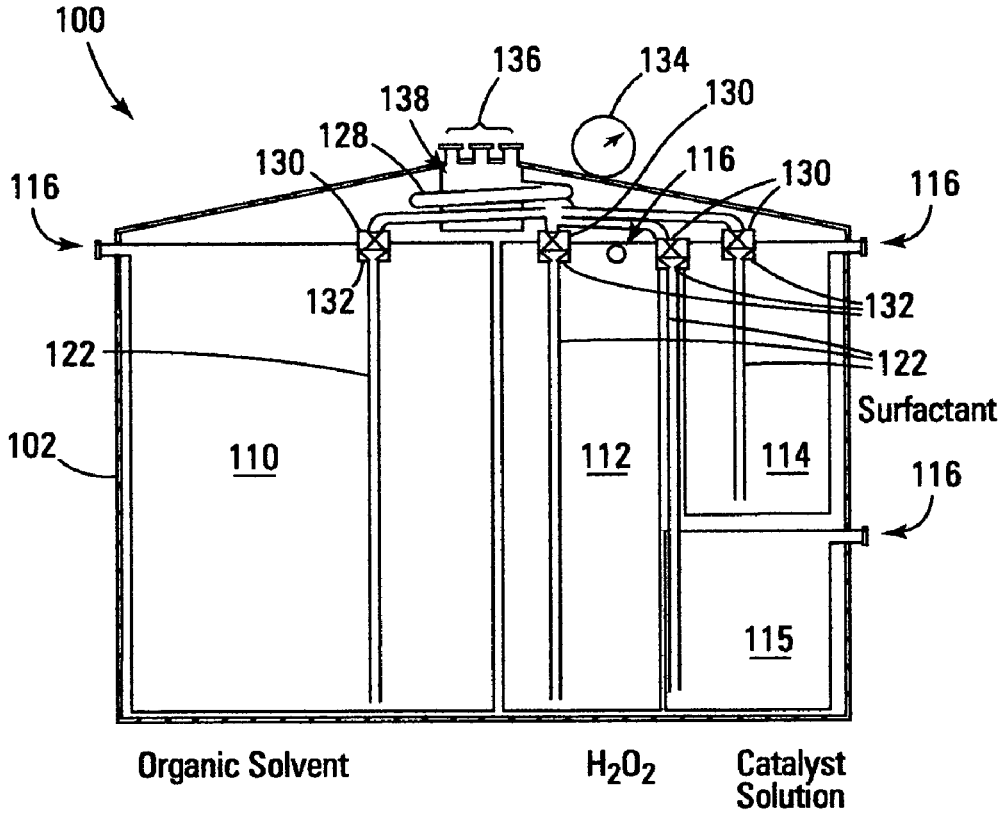
FIG. 2 represents an alternative embodiment of a system for storage and mixing of a multi-ingredient solution according to the present invention.

FIG. 1 shows a cross-sectional view of an integrated storage system 100 that includes a reservoir tank 102 for separately storing a number of ingredients of a solution that is not compatible for storage in a pre-mixed formulation. Tank 102 is divided horizontally by internal dividing walls into a number of separate compartments corresponding to the number of precursor components or ingredients in which the multi-ingredient solution will be stored. FIG. 1 shows three internal compartments 110, 112 and 114 and FIG. 2 shows four internal compartments, 110, 112 and 114 and 115. Compartments 110, 112 and 114 of FIG. 1 are suitable for storage of a DECON GREEN formulation having three precursor components: peroxide, organic solvent/surfactant mix, and catalyst solution. Compartments 110, 112 and 114 and 115 of FIG. 2 are suitable for a DECON GREEN formulation having four precursor components: peroxide, organic solvent, surfactant and catalyst solution. The compartments 110, 112 and 114 and 115 of tank 102 are proportionately sized and adapted to store precursor components of the multi-ingredient solution. In FIGS. 1 and 2, these compartments are disposed horizontally relative to each other, although it will be realized that any suitable compartment arrangement may also be used.

The overall construction of tank 102 will vary depending upon factors such as tank size, location and physical characteristics of the component ingredients to be stored. The tank 102 may be of any suitable construction and may be of any suitable size and shape. For example, tank 102 may be constructed from galvanized, stainless or carbon steel, a chemically resistant plastic, or a glass, fiberglass or composite material. Where volatile or corrosive ingredients are stored, compartments 110, 112, 114 and 115 should be constructed of or lined with appropriately chemically resistant and non-contaminating materials to ensure safe and stable long-term containment. For storage of the ingredients of DECON GREEN a plastic material such as polyethylene can be used. In applications where an ingredient is expected to separate over time, a mixer or agitator may be provided in the compartment for storing the separable ingredients to provide for uniform mixing prior to blending with other ingredients. Insulating materials and heating and/or cooling coils, and the like, may also be provided, as necessary, to maintain ingredients in the liquid state, or at some predetermined temperature. Access ports or manholes may also be provided in some applications for interior inspection and maintenance of tank 102.

Depending on the requirements of a particular application tank 102 may be free standing and stationary or may include a support frame. In permanent above ground installations, a foundation such as a concrete slab may also be provided to maintain a level operating condition. In other applications where portability is desired, tank 102 may be mounted on a skid, trailer, or on a truck. The overall size of tank 102 may be varied corresponding to the needs of a particular application.

Fill ports 116 are positioned near the top of each compartment of tank 102 for loading and replacement of ingredients as necessary. In a preferred embodiment, fill ports 116 may include vents to maintain pressure equilibrium. For most applications, system 100 will provide storage at ambient air pressure and each compartment will be vented to provide pressure/vacuum relief as ingredients expand and contract or are added or withdrawn In other embodiments, where it is desirable to maintain the contents of one or more compartments of tank 102 under pressure, fill ports 116 may include pressure seals and appropriate relief valves to maintain the contents at the desired pressure.

The system 100 also includes various fluid conduits, valves, connectors, probes, sensors, controls and gauges for withdrawing and continuous mixing of the multipart solution and to monitor flow rates and other process parameters to ensure that the proper mix of ingredients is provided. In a preferred embodiment, each compartment 110, 112, 114 and 115 is equipped with a dip tube 122 for withdrawing ingredients. Dip tubes 122 extend down vertically through an opening in the top of each compartment to a level near the bottom and include one or more inlet apertures disposed near the bottom end where the ingredients are drawn. While the compartments are shown as having flat bottoms in FIGS. 1 and 2, in other embodiments, the compartment bottoms may be dished or coned to improve the flow of ingredients toward the dip tubes 122. The top end of each dip tube 122 is coupled to a fluid conduit, which, in turn, is coupled to a manifold 128 where the ingredients are combined in a continuous blending operation. Flow regulators 130 control and meter the flow of the component ingredients from the dip tubes 122 to provide for correct mixing ratios of ingredients. Flow regulators 130 may be manually or servo and/or processor controlled. To ensure that a backflow of mixed solution will not contaminate the ingredients stored in compartments 110, 112, 114 and 115 occur, check valves 132 are provided in the conduits between the manifold 128 and the dip tubes 122 in each of the compartments.

To facilitate blending of ingredients, mixing manifold 128 extends in a coil around a sump 138. While the manifold 128 is shown in FIGS. 1 and 2 as extending for approximately ¾ turn around sump 138, the coil may be shorter or longer depending on the requirements of a particular application. An output aperture of the manifold 128 is coupled to the sump 138 where a small quantity of the mixed ingredients are drawn and collected. Sump 138 may be pre-primed with mixed ingredients to facilitate vacuum pumping. Sump 138 includes one or more discharge ports 136 (three are shown in FIGS. 1 and 2) which preferably are provided with quick connect fittings to facilitate attachment of hoses for applicators, pumps or other devices for transport or application of the mixed ingredients.

One or more display devices 134 (shown symbolically as a single display device in FIGS. 1 and 2) are preferably provided to monitor storage conditions and/or process parameters during mixing operations. Display devices 134 may include gauges, meters, computer monitors or the like which will display data to monitor ingredient fluid levels, flow rates, mixing ratios, and the like. Additional data to monitor liquid temperatures and pressure levels may also be displayed, as desired, for a particular application. Flow control and system operation may be manually controlled by an operator or may be automatically monitored and controlled by a computer running appropriate software as would be known to one of skill in the art.

The mixed solution output from discharge ports 136 can be applied by one or more decontamination applicator units (not shown) which preferably will be connected to tank 102 by quick connect fittings. Alternatively, the mixed solution can be pumped into smaller portable storage tanks from which it can be withdrawn and applied.

A number of embodiments of the invention defined by the following claims have been described. Nevertheless, it will be understood that various modifications to the described embodiments may be made without departing from the spirit and scope of the claimed invention. Accordingly, other embodiments are within the scope of the invention, which is limited only by the following claims.

What is claimed is:

1. A system for storage and mixing of a solution comprising a plurality of ingredients not compatible for long-term storage in a pre-mixed formulation, said system comprising:

(a) a storage tank divided into a plurality of compartments, each compartment adapted to isolate and store an ingredient, and wherein the storage capacity of each compartment is proportionate to an amount of an ingredient in the mixed solution;

(b) a plurality of fluid conduits for withdrawing and conveying ingredients from said compartments;

(c) a manifold coupled to said compartments, wherein said manifold provides for continuous mixing of the ingredients as they are withdrawn from said compartments; and wherein said manifold comprises a coil disposed around a sump; and wherein said sump is coupled to an output aperture of said manifold for holding a quantity of the mixed solution and comprising at least one discharge port;

(d) a plurality of control valves disposed in said fluid conduits for regulating the flow of ingredients from said compartments to said manifold, so that the ingredients are appropriately mixed in said manifold to produce the desired solution;

(e) a plurality of one way valves disposed in said fluid conduits to prevent a backflow of the ingredients into said compartments;

(f) a display device to enable monitoring of one or more system parameters; and (g) a plurality of fill ports disposed in each compartment for loading ingredients.

2. The system of claim 1, wherein said fluid conduits comprise dip tubes that extend down from an upper level of said compartments to a level near the bottom and include an inlet aperture.

3. The system of claim 1, wherein said manifold is positioned at a level above the level of said compartments.

4. The system of claim 1, wherein said compartments include vents to provide pressure and/or vacuum relief.

5. The system of claim 1, wherein said display device comprises a means for monitoring a liquid level in said compartment.

6. A system for storage and mixing of a solution comprising a plurality of ingredients not compatible for long-term storage in a pre-mixed formulation, said system comprising:

(a) a storage tank divided into a plurality of compartments, each compartment adapted to isolate an ingredient and sized in proportion to the amount of that ingredient required for the solution, wherein the compartments include vents to provide pressure and/or vacuum relief and ports for loading ingredients;

(b) a plurality of fluid conduits for withdrawing and conveying ingredients from said compartments comprising dip tubes that extend down from an upper level of each compartment to draw ingredients up from a level near the bottom of said compartments;

(c) a plurality of control valves positioned in said conduits for regulating the flow of ingredients from said compartments to maintain a desired proportion of ingredients during mixing to produce the desired solution;

(d) a plurality of one way valves disposed in said fluid conduits to prevent backflow of the solution into said compartments;

(e) a manifold to which each fluid conduit for withdrawing and conveying ingredients from said compartments is coupled, said manifold providing continuous mixing of the ingredients as they are withdrawn from said compartments;

(f) a sump coupled to an output aperture of said manifold for holding a quantity of the mixed solution and comprising at least one discharge port for withdrawing the mixed solution, wherein said sump is disposed at a level above said compartments and said manifold is disposed, at least in part, in a coil around said sump; and (g) a display device to enable monitoring of one or more system parameters.

* * * * *